United States Patent [19]

Jopt

[11] Patent Number: 4,486,958

[45] Date of Patent: Dec. 11, 1984

[54] DRAWING HEAD

[75] Inventor: Uwe Jopt, Wilhelmshaven, Fed. Rep. of Germany

[73] Assignee: Franz Kuhlmann Prazisionsmechanik und Maschinenbau GmbH & Co. KG, Wilhelmshaven, Fed. Rep. of Germany

[21] Appl. No.: 468,964

[22] Filed: Feb. 23, 1983

[30] Foreign Application Priority Data

Feb. 24, 1982 [DE] Fed. Rep. of Germany ..... 3206549

[51] Int. Cl.[3] ..... B43L 13/02

[52] U.S. Cl. ..... 33/438; 33/1 D

[58] Field of Search ..... 33/1 D, 438, 439, 440, 33/441, 442, 497, 499, 500

[56] References Cited

FOREIGN PATENT DOCUMENTS

| | | | |
|---|---|---|---|
| 67584 | 9/1948 | Denmark | 33/438 |
| 844724 | 7/1952 | Fed. Rep. of Germany | 33/438 |
| 1033093 | 6/1958 | Fed. Rep. of Germany | 33/438 |
| 2642424 | 3/1978 | Fed. Rep. of Germany | 33/438 |
| 2948299 | 6/1981 | Fed. Rep. of Germany | 33/438 |
| 344334 | 3/1960 | Switzerland | 33/438 |

*Primary Examiner*—Richard R. Stearns

*Attorney, Agent, or Firm*—Pearne, Gordon, Sessions, McCoy, Granger & Tilberry

[57] ABSTRACT

A drawing head has a base plate which has a central bore and which is rotatably mounted on a drawing machine. A straightedge support assembly includes a straightedge support mounted on a rotatable pin in the central bore. A cover plate is nonrotatably mounted on the pin and supports a gripping knob. A spacing ring is rotatably mounted about the central axis between the base plate and the cover plate. Normal side locking means serve to releasably retain the straightedge support assembly with respect to the spacing ring, and base side locking means serve to releasably retain the spacing ring with respect to the base plate. Each of the locking means has a locking pawl which is pivotally positioned about an axis parallel to the central axis of rotation without play by means of a pivot jaw assembly and which engages and disengages a spring-loaded locking tooth against a locking disc secured with respect to the spacing ring. In order to avoid subjecting the straightedge support to stress moments perpendicular to the axis of rotation, the locking pawls are mounted in a recess formed in a portion of the straightedge support assembly or in the base plate radially adjacent to the proper locking disc and the pivot pin of the pivot jaw assembly extends radially into the pivot jaw.

18 Claims, 3 Drawing Figures

DRAWING HEAD

BACKGROUND OF THE INVENTION

1. Field of the Invention

This invention relates to a drawing head comprising a base plate which has a central bore and which is nonrotatably mounted on a drawing machine, a straightedge support assembly which is mounted on a pin in the central bore which has a straightedge support with a nonrotatably attached top cover plate supporting a gripping knob, a spacing ring between the base plate and the cover plate which turns about the central axis of rotation, and, if necessary, base locking means for releasably retaining the spacing ring with respect to the base plate, whereby each locking means has a locking pawl which is pivotally positioned without play about an axis parallel to the central axis of rotation by means of a pivot jaw assembly and which locks by means of a locking tooth urged or pressed against a locking disc secured on the spacing ring.

2. Description of the Prior Art

One such drawing head is shown in German patent specification (Offenlegungschrift) No. 26 42 424.8, which has a locking means on the upper side for releasably locking the straightedge support assembly with respect to the spacing ring, as well as a locking means on the base or underside for releasably locking the spacing ring with respect to the base plate. The locking pawls are pivotally positioned without play about an axis parallel to the central axis by means of a pivot jaw assembly. The pivot jaw assembly is constructed such that the pivot pin is inserted into the pivot jaw axially from a bearing surface and the pivot jaw is constructed in a recess in the locking pawl. While the locking pawl is positioned in the plane of the adjoining locking disc, the pivot pin is anchored below and above this plane in the bearing surfaces of either the straightedge support assembly or the base plate. The substantial locking forces which operate on the locking means in the locked phase produce thereby undesirable stress moments perpendicular to the axis of rotation which interfere with the long-term precision of the drawing head.

SUMMARY OF THE INVENTION

The objects of the present invention are hereby directed to the construction of a drawing head of the type generally known previously, which has forces resulting from the locked phase which operate on the normal side locking means and the base side locking means, such that the precision of the drawing head is adversely affected as little as possible.

These objects are achieved in accordance with the present invention by providing one or more locking pawls which are each positioned in a recess in the straightedge support assembly or the base plate radially adjoining the appropriate locking disc, and by providing the pivot pin of the pivot jaw assembly extending radially into the pivot jaw.

An advantage of the present invention lies in particular in that the pivot pin extends radially into the pivot jaw and is anchored in the plane of the corresponding locking disc. In the engagement of the locking means, the load or stress forces appear only in the plane of the locking disc without producing larger stress moments perpendicular to the axis of rotation. It is preferable that the pivot pin is formed within a portion of the straightedge support assembly, and correspondingly within a portion of the base plate, which radially surrounds the corresponding locking disc and also extends into the pivot jaw which is cut into the outer contour of the locking pawl. Alternatively, and in particular preferably, the pivot pin can be formed on the locking pawl, preferably on the end of the locking pawl. The pivot jaw is then constructed in a recess which is formed in the straightedge support assembly or in the base plate.

In order to prohibit the inner walls of the jaw from loosening over a period of time, whereby undesirable play of the locking mechanism would be produced, it is preferable to line these walls with hardened inserts. The locking pin is likewise formed of any hardened material. In the event that the pivot pin is formed on the locking pawl, it is preferable that the entire locking pawl be made of hardened material.

In accordance with the preferred embodiments of the invention, the support points between the pivot jaw and the pivot pin, and between the locking tooth and the locking slot, lie in a straight line which is in the plane of operation of the locking pawl. It is thereby assured that the stress or load of the engaged locking mechanism will not give rise to any stress moment parallel to the axis of rotation, but rather only produces a force through the proper support point, and the support points absorb the force exerted on the straightedge support during drawing.

It is especially preferable that the locking pawl of the normal side locking mechanism be positioned in a recess in the straightedge support which is rotatably positioned on bearing means secured to the spacing ring of the drawing machine. The recess inside of the straightedge support has an opening adjacent to the bearing means through which the locking tooth of the locking pawl operates against a peripheral slot formed in the bearing means. The bearing means are rotatably mounted and axially supported in the central bore of the base plate, and the base locking means preferably reside in a recess in the side of the base plate and operate with its locking tooth against a locking slot in the bearing means. This embodiment has the advantage that the locking means are positioned directly in the plane of the base plate, and correspondingly in the plane of the straightedge support, and engage corresponding bearing discs of the bearing means, whereby additional space in the axial direction for a locking means housing is avoided and the drawing head can be constructed especially flat with a relatively thin profile.

BRIEF DESCRIPTION OF THE DRAWINGS

The embodiments of the invention are more fully illustrated in the following drawing, in which.

DETAILED DESCRIPTION OF THE PREFERRED EMBODIMENT

Figure 1:
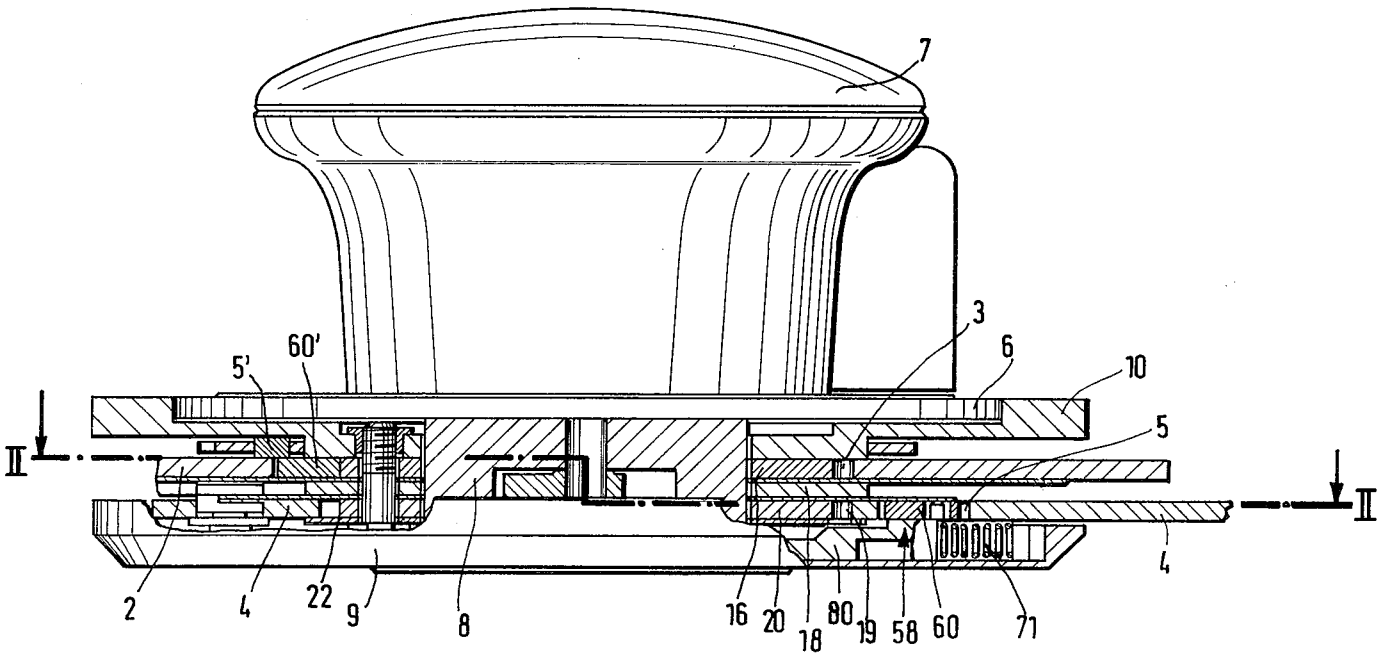
FIG. 1 is a cross section through the drawing head along line I—I of FIG. 2.
Figure 2:
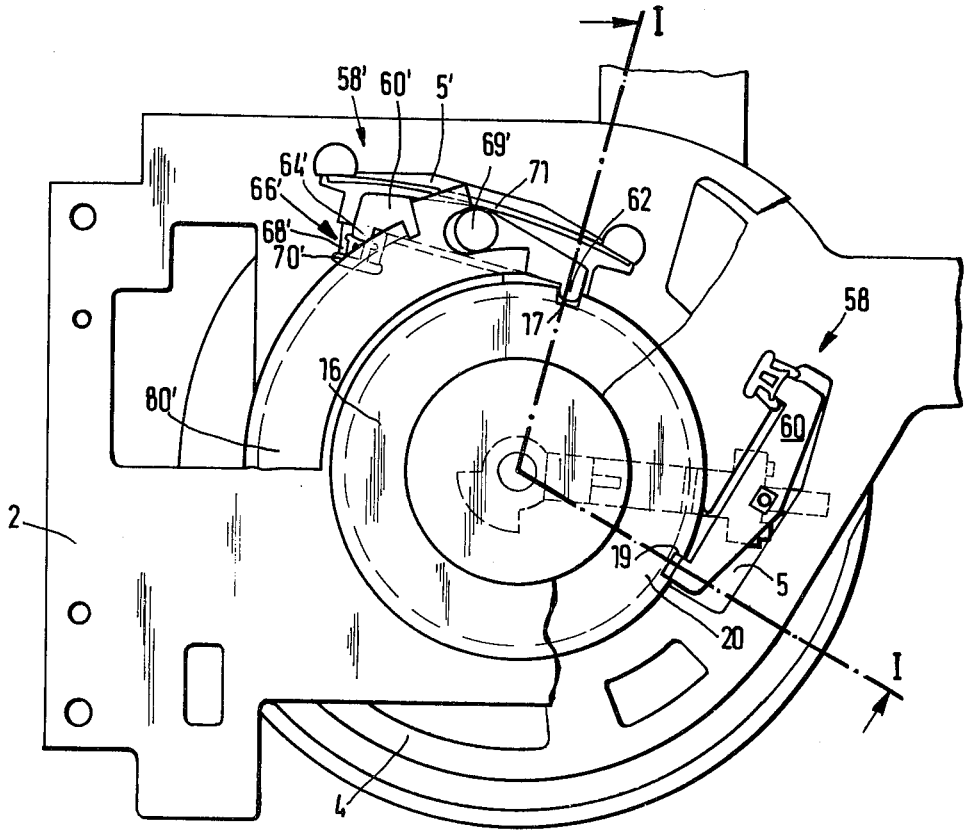
FIG. 2 is an upper sectional view of the drawing head of FIG. 1, taken along line II—II of FIG. 1.
Figure 3:
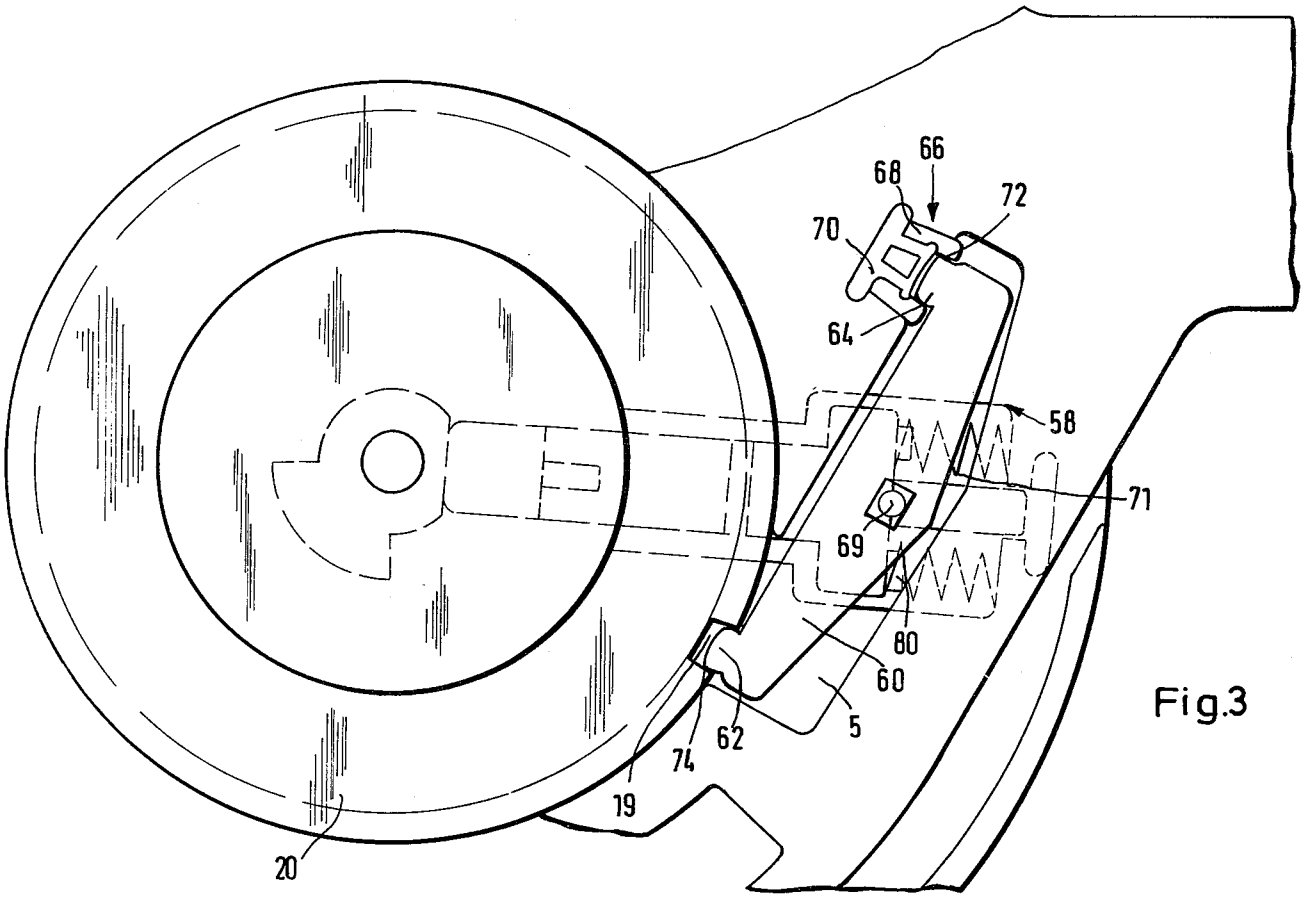
FIG. 3 is a sectional view similar to FIG. 2, showing the normal side locking means to a larger scale.

Referring more particularly to the drawings, and initially to FIGS. 1–3, there is shown the drawing head which comprises a base plate 2 which has a central bore 3 and which is secured to a carriage or parallelogram linkage of the drawing machine by means of an intermediate member (not shown). A straightedge support assembly is provided comprising a straightedge support 4 which is positioned beneath the base plate 2 and which is rotatably mounted above a connecting plate 9 by means of a central pin 8. The central pin 8 extends through the central bore 3 of the base plate 2, and supports at its upper end a cover plate 6 with an attached gripping knob 7.

A spacing ring 10 is provided to which bearing means 16 through 22 are connected between the base plate 2 and the cover plate 6. The bearing means 16–22 are rotatably positioned in the central bore 3 of the base plate 2 with a first bearing disc constructed as a locking disc 16 having a locking slot 17 formed in its outer circumference. The straightedge support assembly 4 through 9 is also rotatably positioned on the bearing means 16–22 so that the straightedge support 4 is rotatably positioned on a second bearing disc 20 of the bearing means. The second bearing disc is likewise constructed as a locking disc 20 and has a locking slot 19 formed in its outer circumference. The drawing head has a normal side locking means 58 for releasably retaining the straightedge support assembly 4–9 with respect to the spacing ring, and correspondingly with respect to the bearing means 16–22 connected to the spacing ring 10, as is shown particularly in FIG. 3. The drawing head has, as well, a base side locking means 58' for releasably retaining the base plate 2 with respect to the spacing ring 10, and correspondingly with respect to the bearing means 16–22 connected to the spacing ring 10, as is shown particularly in FIG. 2.

The locking means 58 and 58' are substantially identical, and both will be described with reference to the locking means 58. The locking means 58 (and correspondingly 58') has a locking pawl 60 (correspondingly 60') which is pivotally positioned without play about an axis parallel to the central axis of rotation by means of a pivot jaw assembly 64 through 70 (correspondingly 64'–70'). The pivot jaw assembly 64–70 is located at one end of the locking pawl 60. A locking tooth 62, which is provided on the other end of the locking pawl 60, engages the locking disc 20 (correspondingly 16) by means of a spring 71. The locking disc 20 (correspondingly 16) has regular circumferentially spaced, axially extending locking slots 19 (correspondingly 17) in which the locking tooth 62 can be engaged.

A recess 5 (correspondingly 5') is formed in the straightedge support 4 (and, correspondingly, in the base plate 2) which has an opening extending radially inwardly toward the locking disc 20 (correspondingly 16) through which the locking tooth 62 (62') of the locking pawl 60 (60') extends into the slots 19 (17) of the locking disc. On the other end of the recess 5 (and, correspondingly, 5') is a pivot jaw 66, the inner walls of which are lined with hardened inserts 68 which are held in position by means of a plastic support or bracket. The hardened inserts 68 of the pivot jaw 66 are mounted so as to be urged toward each other. On the end of the locking pawl 60 opposite the locking tooth 62 is a pivot pin 64 formed in the plane of the flat locking pawl and projecting radially into the pivot jaw 66. The locking pawl 60 has an extension 69 which projects out of the plane of the locking pawl between the locking tooth 62 and the pivot pin 64. An operational element 80 (correspondingly 80') engages the locking pawl 60 to disengage the pawl and push it radially outwardly against the spring 71. Correspondingly, the spring 71 or a similar spring element urges the pawl 60 radially inwardly to engage the locking means by the insertion of the locking tooth 62 into the locking slot 19.

The recess 5 is formed in the straightedge support 4 for the normal side locking means 58 and is similarly formed in the base plate 2 for the base side locking means 58' such that the support points by which the pivot jaw 66 and the pivot pin 64 are engaged with each other, and the support points 74 by which the locking tooth 62 and the locking slots 19 (correspondingly 17) engage each other, respectively lie in a straight line which is in the plane of the pawl. Thereby, the production of stress moments parallel to the axis of rotation by loading the locking mechanism is reliably avoided.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A drawing head for a drawing machine, comprising:

a base plate which has a central bore and which is adapted for being nonrotatably mounted to the drawing machine;

a pin within the central bore;

a straightedge support assembly including a straightedge support, the assembly mounted on the pin in the central bore;

an upper cover plate nonrotatably mounted on the pin, the cover plate having a gripping knob;

a spacing ring rotatably mounted between the base plate and the cover plate to turn about the central axis of rotation;

first locking means for releasable retention of the straightedge support assembly with respect to the spacing ring; and second locking means for releasable retention of the spacing ring with respect to the base plate;

each of the first and second locking means including a locking pawl having a locking tooth, a pivot jaw, and a locking disc, the locking pawl being pivotally supported about an axis parallel to the central axis of rotation by means of the pivot jaw, the locking pawl locking and unlocking by means of the locking tooth being spring-biased against the locking disc which is secured to the spacing ring;

a recess being provided in the straightedge support assembly or the base plate adjacent to the corresponding locking disc, the locking pawl being positioned in the recess;

the locking means also including a pivot pin which projects radially into the pivot jaw.

2. A drawing head as set forth in claim 1, wherein the pivot pin is formed on the locking pawl, and the pivot jaw is constructed in the recess inside the straightedge support assembly or the base plate.

3. A drawing head as set forth in claim 2, wherein the pivot jaw has sidewalls which have hardened inserts.

4. A drawing head as set forth in claim 3, wherein the pivot jaw and pivot pin are supported by one another at first support points, the locking tooth of the locking pawl is supported in the locking disc at second support points, the first support points and the second support points lying in a straight line.

5. A drawing head as set forth in claim 3, comprising, in addition:

bearing means rotatably positioned and axially supported by the central pin of the straightedge support assembly engaged in the central bore of the base plate;

the straightedge support being axially supported and rotatably positioned on the bearing means;

the bearing means having a slot;

the locking pawl of the first locking means being positioned in a recess in the straight edge support which has an opening facing toward the bearing means, the locking tooth of the locking pawl engaging the slot in the bearing means through the opening.

6. A drawing head as set forth in claim 5, wherein the locking pawl of the second locking means is positioned in a recess in the base plate which has an opening facing toward the bearing means, the locking tooth of the locking pawl engaging the slot in the bearing means through the opening.

7. A drawing head as set forth in claim 2, wherein the pivot jaw and pivot pin are supported by one another at first support points, the locking tooth of the locking pawl is supported in the locking disc at second support points, the first support points and the second support points lying in a straight line.

8. A drawing head as set forth in claim 2, comprising, in addition:

bearing means rotatably positioned and axially supported by the central pin of the straightedge support assembly engaged in the central bore of the base plate;

the straightedge support being axially supported and rotatably positioned on the bearing means;

the bearing means having a slot;

the locking pawl of the first locking means being positioned in a recess in the straight edge support which has an opening facing toward the bearing means, the locking tooth of the locking pawl engaging the slot in the bearing means through the opening.

9. A drawing head as set forth in claim 8, wherein the locking pawl of the second locking means is positioned in a recess in the base plate which has an opening facing toward the bearing means, the locking tooth of the locking pawl engaging the slot in the bearing means through the opening.

10. A drawing head as set forth in claim 1, wherein the pivot jaw has sidewalls which have hardened inserts.

11. A drawing head as set forth in claim 10, wherein the pivot jaw and pivot pin are supported by one another at first support points, the locking tooth of the locking pawl is supported in the locking disc at second support points, the first support points and the second support points lying in a straight line.

12. A drawing head as set forth in claim 10, comprising, in addition:

bearing means rotatably positioned and axially supported by the central pin of the straightedge support assembly engaged in the central bore of the base plate;

the straightedge support being axially supported and rotatably positioned on the bearing means;

the bearing means having a slot;

the locking pawl of the first locking means being positioned in a recess in the straight edge support which has an opening facing toward the bearing means, the locking tooth of the locking pawl engaging the slot in the bearing means through the opening.

13. A drawing head as set forth in claim 12, wherein the locking pawl of the second locking means is positioned in a recess in the base plate which has an opening facing toward the bearing means, the locking tooth of the locking pawl engaging the slot in the bearing means through the opening.

14. A drawing head as set forth in claim 1, wherein the pivot jaw and pivot pin are supported by one another at first support points, the locking tooth of the locking pawl is supported in the locking disc at second support points, the first support points and the second support points lying in a straight line.

15. A drawing head as set forth in claim 14, comprising, in addition:

bearing means rotatably positioned and axially supported by the central pin of the straightedge support assembly engaged in the central bore of the base plate;

the straightedge support being axially supported and rotatably positioned on the bearing means;

the bearing means having a slot;

the locking pawl of the first locking means being positioned in a recess in the straight edge support which has an opening facing toward the bearing means, the locking tooth of the locking pawl engaging the slot in the bearing means through the opening.

16. A drawing head as set forth in claim 15, wherein the locking pawl of the second locking means is positioned in a recess in the base plate which has an opening facing toward the bearing means, the locking tooth of the locking pawl engaging the slot in the bearing means through the opening.

17. A drawing head as set forth in claim 1, comprising, in addition:

bearing means rotatably positioned and axially supported by the central pin of the straightedge support assembly engaged in the central bore of the base plate;

the straightedge support being axially supported and rotatably positioned on the bearing means;

the bearing means having a slot;

the locking pawl of the first locking means being positioned in a recess in the straight edge support which has an opening facing toward the bearing means, the locking tooth of the locking pawl engaging the slot in the bearing means through the opening.

18. A drawing head as set forth in claim 17, wherein the locking pawl of the second locking means is positioned in a recess in the base plate which has an opening facing toward the bearing means, the locking tooth of the locking pawl engaging the slot in the bearing means through the opening.

* * * * *